US005851111A

United States Patent [19]

Long et al.

[11] Patent Number: 5,851,111

[45] Date of Patent: Dec. 22, 1998

[54] EQUINE DENTAL FLOAT ADAPTER

[76] Inventors: Raymond D. Long, 715 Greenbrae Dr., Sparks, Nev. 89431; Scott Greene, P.O Box 5780, Sparks, Nev. 89432

[21] Appl. No.: 881,174

[22] Filed: Jun. 23, 1997

Related U.S. Application Data

[63] Continuation-in-part of Ser. No. 566,112, Dec. 1, 1995, abandoned.

[51] Int. Cl.[6] ..... A61D 5/00

[52] U.S. Cl. ..... 433/1

[58] Field of Search ..... 433/1, 122; 30/392

[56] References Cited

U.S. PATENT DOCUMENTS

| | | | |
|---|---|---|---|
| 741,519 | 10/1903 | Mahaffy | 433/1 |
| 889,462 | 6/1908 | Helm | 433/1 |
| 1,046,560 | 12/1912 | Coulson | 433/122 |
| 1,821,079 | 9/1931 | Schultze | 433/122 |
| 3,028,890 | 4/1962 | Atkinson et al. | 30/392 |
| 3,033,251 | 5/1962 | Atkinson et al. | 279/90 |
| 4,365,397 | 12/1982 | Felpel | 30/392 |
| 5,615,746 | 4/1997 | Chu | 30/392 |

OTHER PUBLICATIONS

Catalog Equine Veterinary Product Line.
Catalog E.V.D.I. 1996–1997 Catalog.
Catalog JorVet Equine Radiology Equipment.
Catalog Equine Denistry —Sports Equine Therapy.
Catalog Milburn Distributions, Inc., Fall, 1995—Equine Dental Equipment Catalog.

*Primary Examiner*—John J. Wilson
*Attorney, Agent, or Firm*—Ian F. Burns

[57] ABSTRACT

An adapter for attaching an equine dental float with a rectangular cross section to a reciprocating saw. The adapter comprises a first and second end. The second end is adapted to be received in a slot of an attachment device of the reciprocating saw. The float is held so that its upper and lower surfaces are substantially horizontal when the saw is held in a preferred orientation.

15 Claims, 2 Drawing Sheets

52
50
54
56
10
60
64
24

52
50
54
10
1C
56
60
64
66
24
58

22
17
56

22
17
56
22

22
56
10
60

14
12
10
62
60

EQUINE DENTAL FLOAT ADAPTER

CROSS REFERENCES TO RELATED APPLICATIONS

This application is a continuation-in-part of application Ser. No. 08/566,112 filed on Dec. 1, 1995 now abandoned.

BACKGROUND OF THE INVENTION

1. Field of Invention

This invention relates to an adapter and method for connecting an equine dental float to a handheld reciprocating saw.

2. Description of Related Art

Horses often develop sharp points on their teeth from uneven wear. These ridges, if not removed, can cause sores and ulcers in a horse's mouth. Eventually, the overall health of the horse may be significantly effected. To remove these ridges, veterinarians have developed a procedure known as "floating". This procedure requires the use of a "float", a file-like instrument, to smooth the surfaces of the horse's teeth. To perform the procedure, the horse is sedated, its head is supported, the float is inserted into the horse's mouth, and the float is manipulated in a back and forth motion to abrade the points on the teeth.

However, dental floats, as currently designed, are difficult and time consuming to use. While administering treatment, the veterinarian must hold the float high enough to insert it into the horse's mouth (the horse remains standing even while sedated) and physically manipulate the float in a reciprocating motion. This can be extremely tiring for the veterinarian. Consequently, the floating procedure requires a relatively large amount of time and effort.

Powered devices have been developed for mechanically reciprocating floats. An example of such a device is found in U.S. Pat. No. 741,519 issued to Mahaffy. However, this and other mechanical float devices require specially designed and manufactured complex equipment to produce a reciprocating motion. Mahaffy, for example, requires a specially designed rotating cable drive mechanism. Because of this, these devices are unreliable, expensive to manufacture, and difficult to maintain.

It has been found that commonly used handheld reciprocating saws provide a suitable reciprocating motion. The motion, power, portability, reliability, and convenience of these tools makes them well suited as a means for driving equine floats. Although handheld reciprocating saws are well known in the carpentry and construction industries, no adequate means have been available for attaching floats to these saws.

Numerous devices have been developed for attaching saw blades to reciprocating saws. However, saw blade attachment devices are not suitable for attaching equine floats. Equine floats have different dimensions and shapes than saw blades; they are generally thicker and wider. Furthermore, saw blade attachment devices do not hold floats in a preferred orientation. Almost all saw blade attachment devices are designed to hold saw blades vertically; the flat sides of a blade are vertical when the saw teeth are pointing downward. This allows a user to comfortably and safely apply force to the teeth of the saw. The flat upper and lower surfaces of a float, on the other hand, must be horizontal when the grinding surface of the float is pointing downward or upward. If a float is inserted directly into a saw, assuming the float could be inserted into a saw, the entire apparatus must be rotated 90 degrees in order to hold the float in its preferred position; with the grinding surface pointing downward or upward. Yet this is an uncomfortable position for the user because the handles of most saws are not designed for use in this orientation. Therefore, a need exists for an adapter that is capable of attaching an equine float to commonly used reciprocating saws. The adapter not only securely attaches the float to the saw but also holds the float in its preferred orientation so that a user may comfortably and safely apply force to the grinding surface of the float.

A number of reciprocating dental instruments have been developed for human dentistry. Some of these devices, such as U.S. Pat. No. 1,821,079 to Schultze, attach a file to a reciprocating instrument. However, these devices are completely inadequate for equine dentistry. Equine dentistry requires the use of much greater force than human dentistry. Instruments used in human dentistry are incapable of generating the forces and withstanding the loads and stresses applied in equine dentistry. Just as a human dentist would never use a reciprocating carpentry saw on a human patient, an equine dentist would never use a reciprocating file intended for humans on a horse. Moreover, the size and shape of an equine float would prevent it from being attached to a reciprocating saw in the manner files are attached to reciprocating human dental instruments.

SUMMARY OF INVENTION

1. Objects of the Invention

In view of the above, it is a primary object of the present invention to provide an adapter for attaching an equine dental float tool to widely used handheld reciprocating saws without significantly modifying the saw blade attachment device of the saw.

It is another object of the present invention to provide an adapter that holds a float in an orientation that is useful to perform a floating procedure.

It is further object of the present invention to provide an adapter that is inexpensive to manufacture.

It is another object of the present invention to provide an adapter that may be used with a variety of reciprocating saw devices.

Yet another object of the present invention is to provide an adapter that may be attached to a variety of equine floats.

A further object of the present invention is to provide a method of using a float with an adapter and reciprocating saw.

Yet another object is to provide an adapter which is simple and efficient to use.

These and other objects of the present invention may be realized by reference to the remaining portions of the specification, claims, and abstract.

2. Brief Description of the Invention

The present invention comprises a substantially flat adapter having a first and second end. The first end is adapted to be attach to a float handle and the second end is adapted to be inserted into an attachment device of widely used reciprocating saws. The first end may have two prongs and a slot for receiving the float. The adapter and the float may be permanently attached by welding or by other attachment methods that are well known in the art. Alternatively, the adapter may be integrally formed with the float.

The present invention is intended for use with widely used handheld reciprocating saws or other industrial tools that produce a reciprocating motion. Those devices may be powered by batteries, wall current, or compressed air. Most widely used saws have attachment devices for attaching saw blades to the reciprocating components of the saw. These attachment devices have a slot for receiving the substantially flat attachment ends of saw blades and a locking device, such as a screw, for holding the blades in the slot. The second end of the adapter of the present invention is adapted to be inserted in the attachment devices of reciprocating saws. The second end is substantially flat and the retaining or locking devices may be used to hold the adapter in the attachment device.

The above description sets forth, rather broadly, the more important features of the present invention so that the detailed description of the preferred embodiment which follows may be better understood and contributions of the present invention to the art may be better appreciated. There are, of course, additional features of the invention that will be described below and which will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

REFERENCE NUMERALS

Figures 1A, 1B, 1C, 2B, 7, 8:
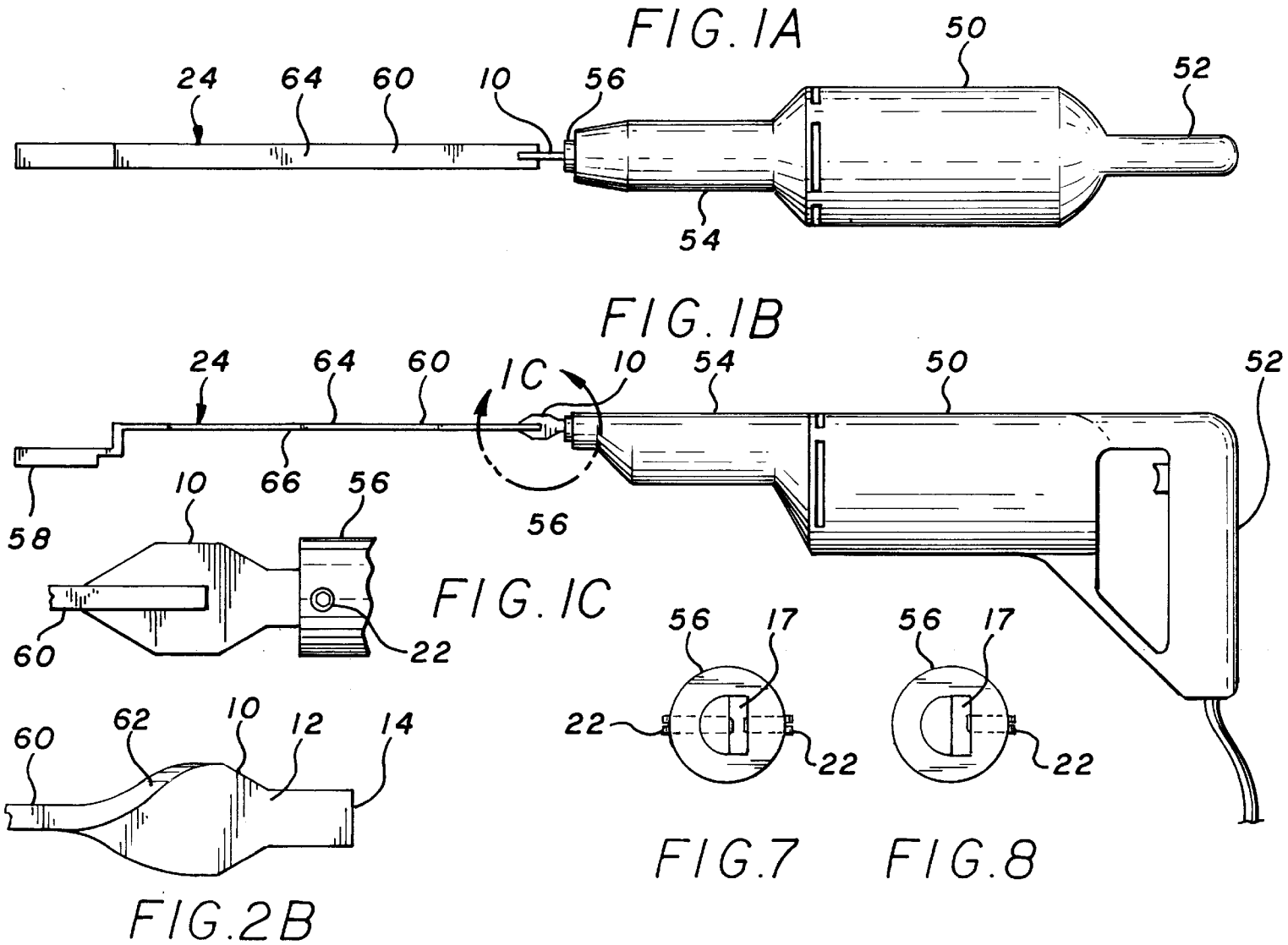
FIG. 1A is substantially a top view of the present invention in use with a float and a reciprocating saw.
FIG. 1B is substantially a side view of the present invention in use with a float and a reciprocating saw.
FIG. 1C is substantially a detailed view of the present adapter shown in FIG. 1A.
FIG. 2B is substantially a side view of an alternative embodiment of the present adapter.
FIG. 7 is substantially a front view of an attachment device for removably attaching a saw blade, as found on a typical reciprocating saw.
FIG. 8 is substantially a front view of an alternative attachment device for removably attaching a saw blade, as found on typical reciprocating saws.

10 adapter
12 member
14 second end
16 first end
17 slot
22 screw
24 flat
26 weld
28 prongs
30 space
50 reciprocating saw
52 handle
54 handle
56 attachment device
58 grinding surface
60 shaft
62 twisted portion
64 upper surface
66 lower surface

DESCRIPTION OF THE PREFERRED EMBODIMENT

Referring now in detail to the drawings wherein like characters refer to like elements throughout the various views.

As seen in FIGS. 1A, 1B, 1C, and 1D, the present invention comprises an adapter 12 that attaches a float 24 to a saw 50. Saw 50 may be any of a number of handheld saws or tools that produce a reciprocating motion. For example, a Makita J3000V variable speed, reciprocating saw is well suited for floating procedures. Although intended for use in carpentry and construction, this saw and other similar devices provide sufficient power, durability, and control to efficiently perform floating procedures. An important feature of this model is that it has a stroke length of approximately one and one eighth inches. It has been found that saws with shorter stroke lengths do not perform efficiently in float procedures. Shorter stroke lengths do not allow the grinding surface of the float to remove as much tooth material per stroke; consequently, they take significantly more time to perform a floating procedure. Therefore, it is a feature of the present invention that saw 50 has a stroke length of substantially at least one-inch.

Saw 50 comprises handles 52 and 54 for allowing a user to operate and control the saw. When used as a saw in its preferred orientation, a saw blade is inserted in an attachment device 56, such as a collar, so that a user may comfortably exert a downward force on the teeth of the blade while the user is holding handles 52 and 54. The blade is held so that the flat sides of the blade are vertical. However, equine floats require force to be applied perpendicular to the grinding surface of the float. As seen in FIGS. 1A and 1B, float 24 has a grinding surface 58 and a shaft 60 with a rectangular cross section and an upper surface 64 and lower surface 66. The rectangular cross section allows the user to determine the angular position of grinding surface 58 when the grinding surface is inserted into a horse's mouth and out of the user's sight (Nearly the entire float must be inserted into a horse's mouth to reach the rear teeth). Thus, a float must be held so that the lateral axis and upper and lower surfaces 64 and 66 of the shaft are substantially horizontal when the user is holding saw 50 in its preferred orientation. Therefore, adapter 10 is designed to hold float 24 in a position that is rotated 90 degrees from the normal position of a saw blade. This allows a user to comfortably exert a downward or upward force on float 24 while holding saw 50 in its preferred orientation.

As seen in FIGS. 7 and 8, commonly used reciprocating saws typically have attachment device 56 with a horizontal slot 17 for receiving a saw blade. Slot 17 is substantially vertical when saw 50 is held in a preferred orientation. Different types of fastening means may be used to lock the saw blade into slot 17. In FIG. 7, two screws 22 are used to pinch and hold the saw blade. A second commonly used design, as shown in FIG. 8, utilizes one screw 22. Adapter 10 of the present invention may be used with either of these designs.

Figures 1D, 2A, 3, 4, 5, 6:
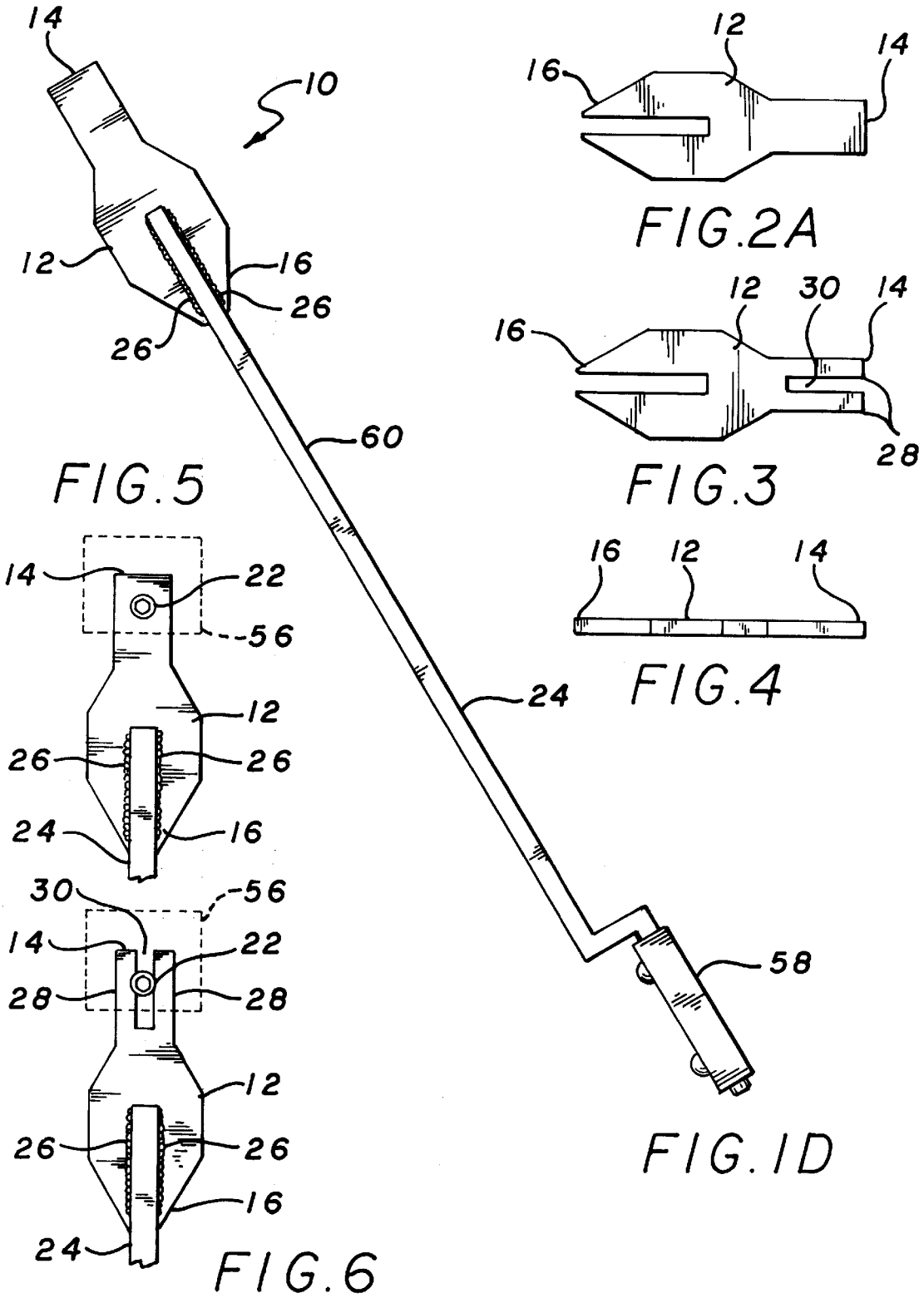
Figure 1D is substantially a side view of the present adapter when attached to an equine dental float.
FIG. 2A is substantially a side view of a preferred embodiment of the present adapter.
FIG. 3 is substantially a side view of another embodiment of the present adapter.
FIG. 4 is substantially a top view of the adapter shown in FIGS. 2 and 3.
FIG. 5 is substantially a side view of the present adapter of FIG. 2, when inserted and attached to an attachment device commonly found on reciprocating saws, with the attachment device shown in ghost lines.
FIG. 6 is substantially a side view of the present adapter of FIG. 2, when inserted and attached to an attachment device commonly found on reciprocating saws, with the saw shown in ghost lines.

As seen in FIGS. 1–6, adapter 10 comprises a substantially flat member 12 made from any suitable material of choice, such as metal or plastic. Adapter 10 includes a first end 16 and a second end 14. First end 16 is a size and shape to be attached at a location of choice on float 24. Preferably, adapter 10 is attached to the extreme end of the shaft. Any suitable attachment means may be used, such as by welding 26, glue, or brackets and screws. Alternatively, adapter 10 may be integrally formed with float 24. For example, as seen in FIG. 2B, the end of float 24 may have a twisted portion 62 that twists 90 degrees and places second end 14 perpendicular to the lateral axis of shaft 60. As seen in FIG. 5, second end 14 is a size and shape to be inserted into slot 17 (see FIGS. 7 and 8) of a reciprocating saw and held in place by whatever attachment device is used.

As seen in FIGS. 3 and 6, the present invention includes a second embodiment, in which the second end 14 is substantially formed into a two-prong fork creating a space 30 between prongs 28. Space 30 is a shape and size to receive an attachment device that is intended to penetrate through to the opposite side of slot 17. In this embodiment, a pinching force is created by pulling the two sides of slot 17 together.

One of the advantages of adapter 10 is that it may be attached to almost any equine float. It is well known in the equine dentistry that different types of floats achieve different results. For example, a long straight float allows a user to reach the rear molars, such as the lower arcades of the mandible, while a float with a bend is adapted to reach the upper jaw or maxillary teeth.

To use the present invention, a user first selects a float to perform a particular float procedure. The selected float may already have adapter 10 attached to it or the user may be required to attach the adapter by inserting float 24 between the prongs of first end 16. Adapter 10 may be permanently or temporarily attached to adapter 10. The user then inserts second end 14 into attachment device 56 of reciprocating saw 50. The user may then tighten screw 22 to lock adapter 10 in attachment device 56. At this point float 24 and saw 50 are ready to be used in a floating procedure. Float 24 is inserted into a horse's mouth, grinding surface 58 is applied to a tooth, and reciprocating saw 50 is activated. Once the horse's tooth has tooth has been suffciently flattened, the float is removed from the horse's mouth, the screw 22 is loosened, and second end 14 may be removed from attachment device 56.

SUMMARY

Although the description above contains many specifications, these should not be construed as limiting the scope of the invention but as merely providing illustrations of some of presently preferred embodiments of this invention. For example, the size and shape of adapter 10 may be changed and still achieve the objects of the present invention. Thus, the scope of the invention should be determined by the appended claims and their legal equivalents rather than by the examples given.

What is claimed is:

1. An equine dental float system for floating horses' teeth, the system comprising:

(A) a hand held saw for producing a reciprocating motion, said saw having an attachment device for attaching objects to said saw, said attachment device having a slot for receiving the objects, said slot being substantially vertical when said saw is held in a preferred orientation;

(B) a float for floating horses' teeth, said float having a shaft with a rectangular cross section and a lateral axis; and (C) an adapter for attaching said float to said attachment device and, said adapter having a second end adapted to be inserted into said slot of said attachment device wherein said lateral axis of said shaft is substantially horizontal when said second end is held in said attachment device said saw is held in the preferred orientation.

2. The system of claim 1 wherein said adapter comprises a first end for attaching to said float.

3. The system of claim 2 wherein said first end comprises a slot for receiving said float.

4. The system of claim 1 wherein said adapter is integrally formed with said float.

5. The system of claim 4 wherein said adapter comprises a twisted portion.

6. The system of claim 1 wherein said reciprocating saw has a stroke length of at least one inch.

7. The system of claim 1 wherein said second end comprises a two-pronged fork with a central slot for receiving a locking device associated with said attachment device.

8. A combination adapter and equine dental float for removably attaching an equine dental float to a handheld reciprocating saw, the saw having an attachment device for attaching objects to the saw, the attachment device having a slot for receiving the objects, the float having a shaft with a substantially rectangular cross section with an upper and lower surface, the adapter comprising a second end for attaching to the reciprocating saw, said second end having a shape to allow said second end to be inserted into the slot, wherein the adapter is held in an orientation in which the upper and lower surfaces of the shaft are rotated substantially ninety degrees from the slot.

9. The combination of claim 8 wherein said adapter comprises a first end for attaching to said float.

10. The combination of claim 9 wherein said first end comprises a slot for receiving said float.

11. The combination of claim 8 wherein said adapter is integrally formed with said float.

12. The combination of claim 11 wherein said adapter comprises a twisted portion.

13. The combination of claim 8 wherein said reciprocating saw has a stroke length of at least one-inch.

14. The combination of claim 8 wherein said second comprises a two-pronged fork with a central slot for receiving a locking device associated with said attachment device.

15. A method of floating horses' teeth comprising the following steps:

(A) attaching an equine dental float to a reciprocating saw, and (B) reciprocating the float with a stroke length of at least one-inch.

* * * * *